US010495298B2

(12) United States Patent
Lv et al.

(10) Patent No.: US 10,495,298 B2
(45) Date of Patent: Dec. 3, 2019

(54) COMB TOOTH TYPE WATER-COOLED COLUMN AND FURNACE HAVING THE SAME

(71) Applicant: Institute Of Engineering Thermophysics, Chinese Academy Of Sciences, Beijing (CN)

(72) Inventors: Qinggang Lv, Beijing (CN); Xiaofang Wang, Beijing (CN); Ming Gao, Beijing (CN); Guoliang Song, Beijing (CN); Dongyu Wang, Beijing (CN)

(73) Assignee: Institute of Engineering Thermophysics, Chinese Academy of Sciences, Beijing (CN)

( * ) Notice: Subject to any disclaimer, the term of this patent is extended or adjusted under 35 U.S.C. 154(b) by 241 days.

(21) Appl. No.: 15/104,959

(22) PCT Filed: Oct. 13, 2014

(86) PCT No.: PCT/CN2014/088490
§ 371 (c)(1),
(2) Date: Jun. 15, 2016

(87) PCT Pub. No.: WO2015/090104
PCT Pub. Date: Jun. 25, 2015

(65) Prior Publication Data

US 2016/0320051 A1 Nov. 3, 2016

(30) Foreign Application Priority Data

Dec. 20, 2013 (CN) ..... 2013 1 0712004

(51) Int. Cl.

| | |
|---|---|
| ***F22B 31/00*** | (2006.01) |
| ***F23C 10/10*** | (2006.01) |
| ***F23L 9/06*** | (2006.01) |
| ***F23C 10/18*** | (2006.01) |

(52) U.S. Cl.
CPC ..... *F22B 31/0084* (2013.01); *F22B 31/0038* (2013.01); *F22B 31/0061* (2013.01);
(Continued)

(58) Field of Classification Search
CPC .. F23C 10/10; F23C 10/18; F23L 9/06; F22B 31/0084; F22B 31/0061; F22B 31/0038
(Continued)

(56) References Cited

U.S. PATENT DOCUMENTS 3,923,008 A * 12/1975 Beckmann ..... F22B 1/023 122/34
5,050,542 A 9/1991 Cooke
(Continued)

FOREIGN PATENT DOCUMENTS

CN 1239541 A 12/1999
CN 1376249 A 10/2002
(Continued)

OTHER PUBLICATIONS

International Search Report and Written Opinion dated Jan. 21, 2015, in International Patent Application No. PCT/CN2014/088490, filed Oct. 13, 2014, 6 pages.
(Continued)

*Primary Examiner* — Avinash A Savani
*Assistant Examiner* — Rabeeul I Zuberi
(74) *Attorney, Agent, or Firm* — Davis Wright Tremaine LLP; Michael J. Donohue

(57) ABSTRACT

A water-cooled column (4) used in a circulating fluidized bed boiler furnace is disclosed, wherein the water-cooled column is formed by connecting membrane water-cooled walls (41). The water-cooled column (4) includes a lower section (A), an upper section and a transition section. The lower section (A) is a single column and is provided with inner secondary air ports (400) on a side wall thereof. The
(Continued)

upper section includes a plurality of sub-columns (B, C). The membrane water-cooled walls at the lower section (A) extend to the upper section through the transition section. Each of the sub-columns (B, C) is formed by connecting extension portions extending upward from respective membrane water-cooled walls (41) in the membrane water-cooled walls (41), which are connected to form the lower section (A), and the plurality of sub-columns (B, C) are separated from each other.

16 Claims, 3 Drawing Sheets

(52) U.S. Cl.
CPC ..... *F23C 10/10* (2013.01); *F23C 10/18* (2013.01); *F23L 9/06* (2013.01)

(58) Field of Classification Search
USPC ..... 122/235.12, 239, 235.31, 4 D, 235.23, 122/332; 432/15, 58
See application file for complete search history.

(56) References Cited

U.S. PATENT DOCUMENTS 5,678,497 A 10/1997 Goidich
5,836,257 A * 11/1998 Belin ..... F22B 31/0084 110/245
6,470,833 B1 * 10/2002 Hyppanen ..... F22B 31/0084 122/4 D
2011/0073050 A1 * 3/2011 Maryamchik ..... F23C 10/14 122/4 D

FOREIGN PATENT DOCUMENTS

| | | | |
|---|---|---|---|
| CN | 1882804 | A | 12/2006 |
| CN | 101240893 | A | 8/2008 |
| CN | 100565006 | A | 12/2009 |
| CN | 100565006 | C | 12/2009 |
| CN | 101614390 | A | 12/2009 |
| CN | 101718430 | A | 6/2010 |
| CN | 102032558 | A | 4/2011 |
| CN | 102226518 | A | 10/2011 |
| CN | 102226518 | B | 3/2013 |
| CN | 102997231 | A | 3/2013 |
| EP | 0787272 | A1 | 8/1997 |
| WO | 2013140332 | A1 | 9/2013 |

OTHER PUBLICATIONS

Chinese Office Action dated Aug. 22, 2016, issued in Chinese Patent Application No. 201310712004.8, filed on Dec. 20, 2013,12 pages.
Indian Patent Office, Examination Report from Indian Patent Application No. 2016/17020904, dated Jun. 3, 2019, 5 pages.

* cited by examiner

COMB TOOTH TYPE WATER-COOLED COLUMN AND FURNACE HAVING THE SAME

CROSS-REFERENCE TO RELATED APPLICATION

This application is a Section 371 National Stage Application of International Application No. PCT/CN2014/088490, filed on Oct. 13, 2014, entitled "Comb Tooth Type Water-Cooled Column and Furnace Having the Same", which claims priority to Chinese Application No. 201310712004.8, filed on Dec. 20, 2013, incorporated herein by reference in their entirety.

BACKGROUND OF THE INVENTION

Field of the Invention

Embodiments of the present disclosure relate to a circulating fluidized bed boiler, and more particularly, to a heating surface in a furnace of the circulating fluidized bed boiler.

Description of the Related Art

It is an inexorable trend for a circulating fluidized bed boiler technology to develop in a direction of large-scale equipment and high degree of parameterization. As the boiler capacity increases, the cross section of a furnace is also constantly increasing; as a result, secondary air injected from a wall surface into the furnace is difficult to reach the center of the furnace. At the same time, compared to the area increase of an evaporating heating surface in the furnace, the furnace volume is more significantly increased, which causes exothermic and endothermic imbalance and puts forward a new requirement for heating surface arrangement. In summary, the secondary air penetration and the furnace heating surface arrangement have become a major technology bottleneck, which constraints the circulating fluidized bed boiler from developing in the direction of large-scale equipment and high degree of parameterization.

To solve the above technical problems, a Chinese patent ZL 200710151813.0 discloses a circulating fluidized bed boiler furnace with a water-cooled column, in which a water-cooled column formed by connecting membrane water-cooled walls is provided between an air distribution plate and a ceiling of the furnace to increase the furnace heating surface, and secondary air may be injected into the furnace combustion space through the water-cooled column. Since a secondary air pipe is needed to be placed inside the column, it is necessary to keep a certain amount of pipe arrangement and maintenance space. However, the cross-sections of the water-cooled column at different levels are kept constant, it therefore causes that all the internal space of the water-cooled column at various levels in an up-down direction is relatively larger, it further causes that a distance between the water-cooled column and an outer wall of the furnace is relatively small, especially the upper space of the furnace cannot meet the requirement for arranging a platen heating surface, and it brings about some difficult in distributing gas-solid flow in the furnace.

SUMMARY OF THE INVENTION

According to an aspect of the present disclosure, there is provided a water-cooled column used in a circulating fluidized bed boiler furnace, wherein the water-cooled column is formed by connecting membrane water-cooled walls, and the water-cooled column comprises: a lower section configured to be a single column and provided with inner secondary air ports on a side wall thereof; an upper section comprising a plurality of sub-columns; and a transition section, through which the membrane water-cooled walls at the lower section extend to the upper section, wherein each of the sub-columns is formed by connecting extension portions extending upward from respective membrane water-cooled walls in the membrane water-cooled walls, which are connected to form the lower section, and the plurality of sub-columns are separated from each other.

Optionally, the upper section comprises two sub-columns.

Optionally, the upper section comprises three sub-columns arranged in a line and equidistantly spaced apart from each other.

Optionally, the upper section comprises four sub-columns, among which a cross-shaped gap is defined.

Optionally, in the above described water-cooled column, each of the sub-columns has an identical cross-section with any other sub-columns. Further, each of the sub-columns has an identical cross-section area with any other sub-columns.

Optionally, in the above described water-cooled column, each of the sub-columns has a cross-section shape chosen from a rectangle, a circle, a regular hexagon and a regular octagon.

Optionally, in the above described water-cooled column, additional inner secondary air ports are provided on opposite side walls of at least a pair of adjacent sub-columns.

The present disclosure also relates to a circulating fluidized bed boiler furnace, comprising furnace side walls, a ceiling, an air distribution plate and the above described water-cooled column provided between the air distribution plate and the ceiling, wherein a furnace combustion space is enclosed by the water-cooled column side walls, the furnace side walls, the air distribution plate and the ceiling, inner secondary air ports for injecting secondary air into the furnace combustion space are provided at a lower portion of the water-cooled column side walls, and outer secondary air ports for injecting secondary air into the furnace combustion space are provided at a lower portion of the furnace side walls.

Optionally, an extended heating surface is arranged outside at least one of the sub-columns.

The present disclosure also relates to a circulating fluidized bed boiler, comprising the above described circulating fluidized bed boiler furnace.

DETAILED DESCRIPTION OF PREFERRED EMBODIMENTS OF THE INVENTION

Figure 1:
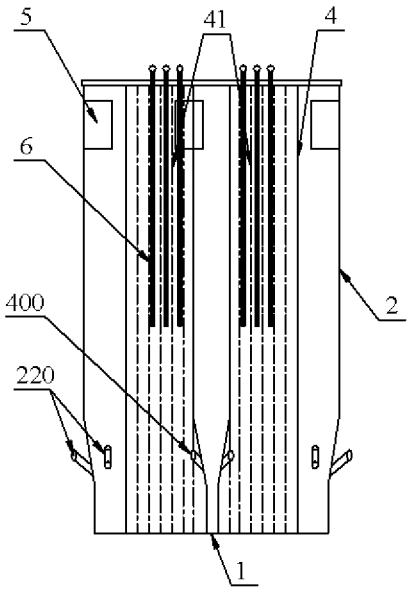
FIGS. 1-3 are schematic front, side and top cross-section views of a circulating fluidized bed boiler with a variable cross-section furnace according to an embodiment of the present disclosure, respectively.

Exemplary embodiments of the present disclosure shown in the accompanying drawings will be described in detail below, wherein the same or similar reference number is intended to indicate the same or similar element. The embodiments described hereafter with reference to the accompanying drawings are exemplary, and are intended to explain the present disclosure, rather than limiting the present disclosure.

Next, a circulating fluidized bed boiler with a variable cross-section furnace will be described with reference to FIGS. 1-11.

As shown in FIGS. 1-11, the cross-section of the furnace of the circulating fluidized bed boiler optionally presents a quadrangle, the circulating fluidized bed boiler comprises: an air distribution plate 1 provided at a bottom of the furnace, a furnace front wall 21, a furnace rear wall 22, a furnace left side wall 23 and a furnace right side wall 24, a ceiling 3, furnace outlets 5 and at least one water-cooled column 4 provided between the air distribution plate and the ceiling, wherein the furnace outlets 5 are connected with a cyclone separator (not shown).

In order to ensure that an arrangement space inside the water-cooled column is sufficient for secondary air tubes, a lower section A of the water-cooled column is configured to be a single column.

Figure 2:
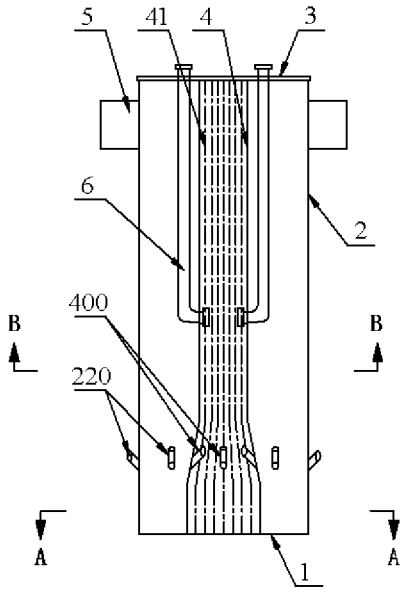
Figure 3:
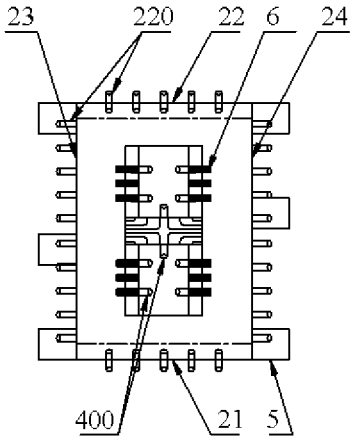
Figure 4:
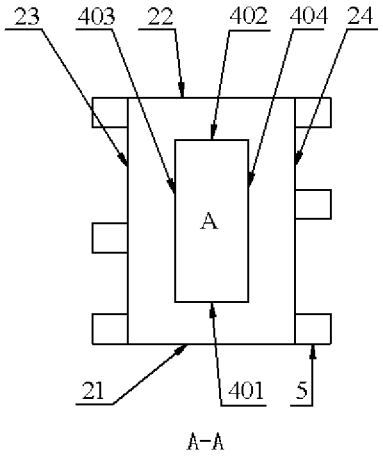
FIGS. 4-5 are schematic cross-section views of a circulating fluidized bed boiler with a variable cross-section furnace according to the embodiment of the present disclosure at a lower level and an upper level, respectively.
Figure 5:
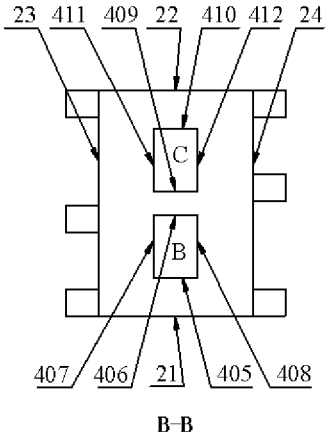

FIGS. 1-3 are schematic front, side and top cross-section views of a circulating fluidized bed boiler with a variable cross-section furnace according to an embodiment of the present disclosure, respectively; FIGS. 4-5 are schematic cross-section views of a circulating fluidized bed boiler with a variable cross-section furnace according to the embodiment of the present disclosure at a lower level and an upper level, respectively.

As shown in FIGS. 4-5, the water-cooled column 4 is formed by connecting membrane water-cooled walls 41, and comprises: a lower section A in a form of a single column at a lower portion of the furnace, an upper section in a form of double columns at middle and upper portions of the furnace. The upper section comprises a sub-column B and a sub-column C, and a transition section configured to connect the lower section A with the sub-sections B, C. The lower section A comprises: a water-cooled column front wall 401 and a water-cooled column rear wall 402 which are arranged opposite to each other and face towards the furnace front wall 21 and the furnace rear wall 22, respectively; and a water-cooled column left side wall 403 and a water-cooled column right side wall 404 which are arranged opposite to each other and face towards the furnace left side wall and the furnace right side wall, respectively. The sub-columns B and C of the upper section of the water-cooled column may be arranged side by side and have identical cross-section. The sub-column B comprises: a front wall 405 and a rear wall 406 which are arranged opposite to each other and in parallel with the furnace front wall 21, respectively; and a left side wall 407 and a right side wall 408 which are arranged opposite to each other and face towards the furnace left side wall 23 and the furnace right side wall 24, respectively. The sub-column C comprises: a front wall 409 and a rear wall 410 which are arranged opposite to each other and in parallel with the furnace rear wall 22, respectively; and a left side wall 411 and a right side wall 412 which are arranged opposite to each other and face towards the furnace left side wall 23 and the furnace right side wall 24, respectively. All the cross-sections of the lower section A as well as the sub-column B and the sub-column C are in a rectangle shape. It should be noted that each of the sub-columns may have a cross-section shape chosen from a rectangle, a circle, a regular hexagon and a regular octagon.

The water-cooled column 4 extends upward from the air distribution plate 1 to the ceiling 3 of the furnace. As the water-cooled column 4 extends from bottom to top, both the oppositely arranged side walls 403 and 404 of the lower section A at the lower portion of the water-cooled column 4 are inclined towards inner sides of the water-cooled column from a certain position above the air distribution plate 1 and below the secondary ports 400 inside the water-cooled column 4, so that the distance between the side walls 403 and 404 is reduced. When the distance between the side walls 403 and 404 is reduced to a certain value, both the side walls 403 and 404 turn to vertically extend upward to the ceiling 3. The oppositely arranged side walls 401 and 402 of the lower section A extend vertically to the ceiling 3 from bottom to top. As a result, an internal space of the water-cooled column is formed as a comb tooth-shaped space with two comb teeth, which are communicated with each other.

Lower portions of the furnace front wall 21 and the furnace rear wall 22 are inclined outwardly from a certain level above the air distribution plate 1, and outer secondary air ports 220 are provided outside the outwardly inclined sections. Both the furnace left side wall 23 and the furnace right side wall 24 extend vertically from bottom to top, outer secondary air ports 220 are also provided outside lower portions of the side walls 23, 24. The furnace outlets 5 connected with the cyclone separator (not shown) are provided in upper portions of the furnace left side wall 23 and the furnace right side wall 24.

As shown in FIGS. 1-3, platen heating surfaces 6 are provided at upper portions outside the left side wall 407 and the right side wall 408 of the sub-column B and outside the left side wall 411 and the right side wall 412 of the sub-column C.

Optionally, platen heating surfaces 6 may also be provided at upper portions outside the front wall 405 and the rear wall 406 of the sub-column B and outside the front wall 409 and the rear wall 410 of the sub-column C.

As shown in FIGS. 3-5, the rear wall 406 of the sub-column B and the front wall 409 of the sub-column C extend vertically to the ceiling 3 from bottom to top. The front wall 405 of the sub-column B and the furnace front wall 21 are arranged in parallel with each other; the rear wall 406 of the sub-column B and the front wall 409 of the sub-column C are arranged in parallel with each other; the rear wall 410 of the sub-column C and the furnace rear wall 22 are arranged in parallel with each other; the left side wall 407 and the right side wall 408 of the sub-column B and the left side wall 411 and the right side wall 412 of the sub-column C are arranged in parallel with the furnace left side wall 23 and the furnace right side wall 24.

Water-cooled wall tubes at left half of the rear wall 406 of the sub-column B are connected with water-cooled wall tubes at front portion of the left side wall 403 of the lower section A through connection tubes; water-cooled wall tubes at right half of the rear wall 406 of the sub-column B are connected with water-cooled wall tubes at front portion of the right side wall 404 of the lower section A through connection tubes. Similarly, water-cooled wall tubes at left half of the front wall 409 of the sub-column C are connected with water-cooled wall tubes at rear portion of the left side wall 403 of the lower section A through connection tubes; water-cooled wall tubes at right half of the front wall 409 of the sub-column C are connected with water-cooled wall tubes at rear portion of the right side wall 404 of the lower section A through connection tubes. In this way, the lower section A at the lower portion of the furnace is transited to the upper section having double columns.

Figure 7:
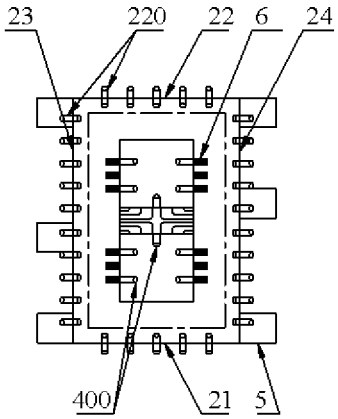
FIGS. 6-7 are schematic front and top cross-section views of a circulating fluidized bed boiler with a variable cross-section furnace according to another embodiment of the present disclosure, respectively.
Figure 6:
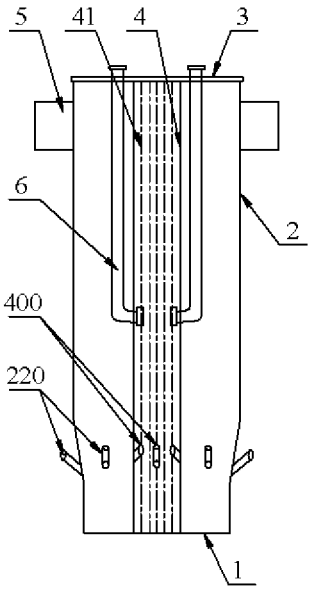

FIGS. 6-7 are schematic front and top cross-section views of a circulating fluidized bed boiler with a variable cross-section furnace according to another embodiment of the present disclosure, respectively. This embodiment is different from the previously described embodiment in a structure of the water-cooled column upper section, while the other structure is similar to the previously described embodiment.

As shown in FIGS. 6-7, the front wall 401 and the rear wall 402 (referring to FIG. 4) of the lower section A, the front wall 405 and the rear wall 406 (referring to FIG. 5) of the sub-column B, the front wall 409 and the rear wall 410 (referring to FIG. 5) of the sub-column C extend vertically to the ceiling 3 from bottom to top. Lower portions of the furnace front wall 21 and the furnace rear wall 22 are inclined outwardly from a certain level above the air distribution plate 1, and outer secondary air ports 220 are provided on the inclined sections.

The width between the left side wall 403 and the right side wall 404 (referring to FIG. 4) of the lower section A is identical to the width between the left side wall 407 and the right side wall 408 (referring to FIG. 5) of the sub-column B, and to the width between the left side wall 411 and the right side wall 412 (referring to FIG. 5) of the sub-column C.

Advantageously, inner secondary air ports 400 are provided in inner sides of the left side wall 407 and the right side wall 408 of the sub-column B and in inner sides of the left side wall 411 and the right side wall 412 of the sub-column C at a certain level thereof. Optionally, inner secondary air ports 400 may also be provided in the inner sides of the front wall 405 and the rear wall 406 of the sub-column B and in the inner sides of the front wall 409 and the rear wall 410 of the sub-column C.

Lower portions of the furnace left side wall 23 and the furnace right side wall 24 are inclined outwardly from a certain level above the air distribution plate 1 to a predefined height, and then extend vertically to the ceiling 3 from bottom to top. Outer secondary air ports 220 are provided outside the inclined section of the lower portions of the furnace left side wall 23 and the furnace right side wall 24 at the same level as the inner secondary air ports 400 in the inner sides of the left and right side walls of the sub-columns B, C.

Platen heating surfaces 6 are provided on outer sides of upper portions of the left side wall 407 and the right side wall 408 of the sub-column B and upper portions of the left side wall 411 and the right side wall 412 of the sub-column C.

Optionally, platen heating surfaces 6 may also be provided on inner sides of the furnace left side wall 23 and the furnace right side wall 24 between two adjacent furnace outlets 5, and provided on outer sides of upper portions of the front wall 405 and the rear wall 406 of the sub-column B and upper portions of the front wall 409 and the rear wall 410 of the sub-column C, according to requirements for heat absorption of the furnace.

Figure 8:
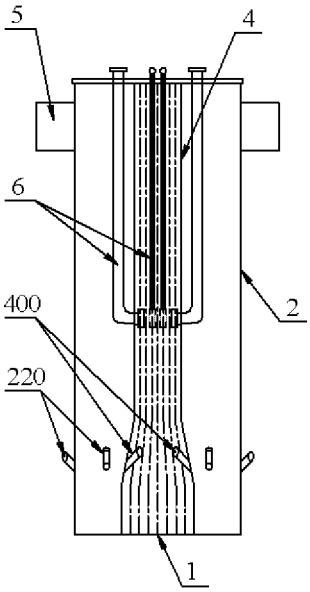
FIGS. 8-10 are schematic front, side and top cross-section views of a circulating fluidized bed boiler with a variable cross-section furnace according to further another embodiment of the present disclosure, respectively.
Figure 9:
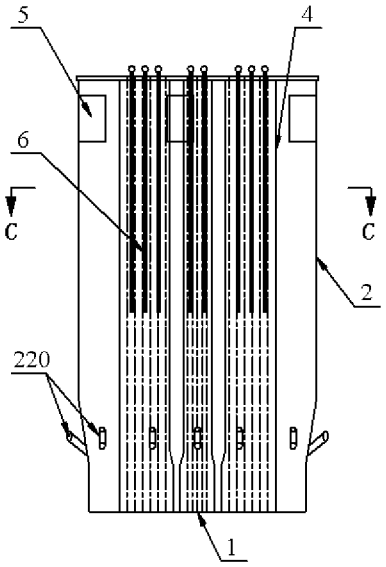
Figure 10:
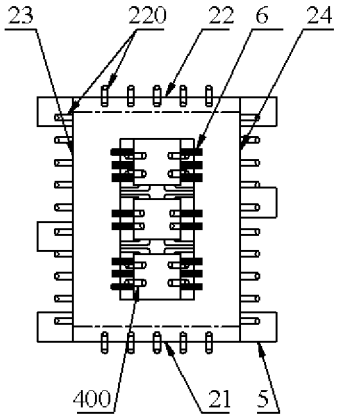
Figure 11:
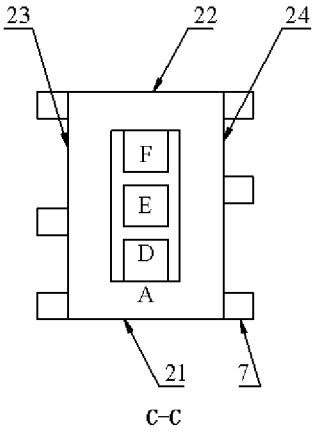
FIG. 11 is a schematic cross-section view of a circulating fluidized bed boiler with a variable cross-section furnace according to the above embodiment of the present disclosure at an upper level.

FIGS. 8-10 are schematic front, side and top cross-section views of a circulating fluidized bed boiler with a variable cross-section furnace according to further another embodiment of the present disclosure, respectively; FIG. 11 is a schematic cross-section view of a circulating fluidized bed boiler with a variable cross-section furnace according to the embodiment of the present disclosure at an upper level. This embodiment is different from the embodiment shown in FIGS. 1-3 in a structure of the upper section, while the other structure is similar to the first embodiment.

As shown in FIGS. 8-11, in a case that a width of the furnace is large enough, in order to improve gas-solid blending and flow uniformity in a horizontal direction at the upper portion of the furnace, the present disclosure provides another comb tooth type water-cooled column, wherein the lower section at a lower portion of the furnace is formed as a single column, which is connected to an upper section having three parallel columns at middle and upper portions of the furnace through a transition section. As a result, a comb tooth-shaped space with three comb teeth is formed inside the water-cooled column.

Both the left and right side walls 403 and 404 (see FIG. 4) of the lower section A are inclined towards inner sides of the water-cooled column from a certain level, and then extend vertically upward to the ceiling 3 from bottom to top after the inclined sections reach to a certain level. Inner secondary air ports 400 are provided in an inner side of each side of the inclined transition section of the water-cooled wall. The front wall 401 and the rear wall 402 (referring to FIG. 4) of the lower section A extend vertically upward to the ceiling 3 from bottom to top so as to form a front wall of a sub-column D and a rear wall of a sub-column F at an upper section of the water-cooled column at a certain level, respectively.

Outer secondary air ports 220 are also provided outside the lower portions of the furnace front wall 21, the furnace rear wall 22, the left side wall 23 and the right side wall 24, at levels corresponding to the levels of the inner secondary air ports 400.

The water-cooled wall tubes at the middle of the left and right side walls 403, 404 of the lower section A are inclined towards inner sides of the water-cooled column at a certain level above the air distribution plate 1 and extend to a predefined height, and then extend to form left and right side walls of the sub-columns D, E, F of the upper section, respectively.

The cross-sections of the sub-columns D, E, F are in a rectangle shape, and have identical cross-section area. Inner secondary air ports 400 are provided on inner sides of lower portions of four membrane water-cooled walls of the sub-columns D, E, F, respectively. Outer secondary air ports 220 are provided outside respective furnace side walls at the same level as the inner secondary air ports 400.

Platen heating surfaces 6 are provided on upper portions of outer sides of the left and right side walls of the sub-columns D, E, F of the upper section, and platen heating surfaces 6 may also be provided on upper portions of outer sides of the front wall of the sub-column D and the rear wall of the sub-column F.

Optionally, platen heating surfaces 6 may also be provided on upper portions of outer sides of the rear wall of the sub-column D, the front and rear walls of the sub-column E, and the front wall of the sub-column F.

In summary, the present disclosure provides a water-cooled column used in a circulating fluidized bed boiler furnace, wherein the water-cooled column is formed by connecting membrane water-cooled walls, and the water-cooled column comprises: a lower section A configured to be a single column and provided with inner secondary air ports 400 on a side wall thereof; an upper section comprising a plurality of sub-columns B, C; D, E, F; and a transition section, through which the membrane water-cooled walls at the lower section A extend to the upper section, wherein the upper section is connected to the lower section by means of the transition section to form a flow passage for working medium of the water-cooled column, which run from the air distribution plate to the ceiling. Each of the sub-columns is formed by connecting extension portions extending upward from respective membrane water-cooled walls in the membrane water-cooled walls, which are connected to form the lower section, and the plurality of sub-columns are separated from each other.

Optionally, as shown in FIGS. 2-5, the upper section comprises two sub-columns B, C.

Optionally, as shown in FIGS. 9-11, the upper section comprises three sub-columns D, E, F arranged in a line and equidistantly spaced apart from each other.

Optionally, the upper section comprises four sub-columns, among which a cross-shaped gap is defined. However, such embodiment is not illustrated.

Optionally, in the above described water-cooled column, each of the sub-columns has an identical cross-section with any other sub-columns. Further, each of the sub-columns has an identical cross-section area with any other sub-columns.

Optionally, in the above described water-cooled column, each of the sub-columns has a cross-section shape chosen from a rectangle, a circle, a regular hexagon and a regular octagon.

Optionally, in the above described water-cooled column, as shown in FIGS. 3 and 7, additional inner secondary air ports 400 are provided on opposite side walls of at least a pair of adjacent sub-columns.

The present disclosure also relates to a circulating fluidized bed boiler furnace, comprising furnace side walls, a ceiling 3, an air distribution plate 1 and a water-cooled column 4 provided between the air distribution plate 1 and the ceiling 3, wherein a furnace combustion space is enclosed by the water-cooled column side walls, the furnace side walls, the air distribution plate and the ceiling, inner secondary air ports 400 for injecting secondary air into the furnace combustion space are provided at a lower portion of the water-cooled column side walls, and outer secondary air ports 220 for injecting secondary air into the furnace combustion space are provided at a lower portion of the furnace side walls.

Optionally, an extended heating surface 6 is arranged outside at least one of the sub-columns.

The present disclosure also relates to a circulating fluidized bed boiler, comprising the above described circulating fluidized bed boiler furnace.

In the present disclosure, by means of the comb tooth type water-cooled column provided in the furnace, it is beneficial to strengthen lateral blending of particles in a horizontal direction of the furnace and full combustion, causes improved uniformity of the lateral gas-solid two phase flow in the furnace, and effectively increases a gas-solid two phase annular flow space in the furnace. As a result, more extended heating surfaces may be arranged to effectively absorb excessive heat in the furnace due to increased steam parameter, and achieve the objective of controlling bed temperature and furnace outlet flue gas temperature. In the present disclosure, the water-cooled column is divided into a single column lower section and a multi-column upper section, and a transition section is provided between the upper section and the lower section. Specifically, the upper section is connected with the lower section through the transition section, so that comb tooth-shaped communicated spaces are formed in the water-cooled column. Further, the membrane-type wall tubes of the lower section extend upward to form the membrane-type wall tubes of the upper section, so that a flow passage for working medium in the water-cooled column is formed from the air distribution plate to the ceiling. Moreover, a combustion space at the lower portion of the furnace where the lower section is located has an annular cross-section, and the air distribution plate also has an annular cross-section, while a combustion space at the middle and upper portion of the furnace where the upper section is located has a shape similar to the Chinese character "口", "日" or the like.

The large-scale circulating fluidized bed boiler furnace according to the present disclosure may achieve at least one of the following advantages:

1) the lower section of the water-cooled column is a single column, the internal space of which is relatively rich to conveniently arrange secondary air pipes and implement maintenance;

2) the water-cooled wall tube of the lower section formed as a single column extends upward in a way of bent pipe to form a multi-column upper section of the water-cooled column, and a sum of perimeters of the cross-sections of various columns of the upper section is substantially equal to a perimeter of the cross-section of the single column of the lower section while the internal space of the formed water-cooled column at the upper section is significantly less than at the lower section, which enables the combustion space, the material flow and the blending space at the middle and upper portion of the furnace to be increased or improved, in contrast to that of the furnace with a constant cross-section water-cooled column. As a result, the flow condition at the middle and upper portion of the furnace becomes better, and it facilitates improving flow uniformity between various circulation loops of the large-scale boiler with a plurality of separator, return feeders, thereby effectively reducing thermal deviation between the platen heating surfaces in the furnace and between the plurality of the cyclone separators, and effectively reducing the risk of water-cooled tube bursting in the furnace, further facilitating improving the operation safety of the boiler;

3) more extended heating surfaces may be arranged on the side walls of the upper section with multi-columns, thereby it highly facilitates arranging the heating surfaces in the furnace of the large-scale boiler, so as to achieve the objective of controlling bed temperature and furnace outlet flue gas temperature, furthermore, the gas-solid blending is more strong, and the gas-solid flow is more uniform.

Although the embodiments of the present disclosure have been shown and described, it should be appreciated by the person skilled in the art that changes may be made to these embodiments without departing from the principle and spirit of the present disclosure. The scope of the present disclosure is defined by the accompanying claims and the equivalents thereof.

What is claimed is:

1. A water-cooled column used in a circulating fluidized bed boiler furnace, wherein the water-cooled column is formed by connecting membrane water-cooled walls, and the water-cooled column comprises:

a lower section configured to be a single column and provided with inner secondary air ports on a side wall thereof;

an upper section comprising a plurality of sub-columns; and a transition section, through which the membrane water-cooled walls at the lower section extend to the upper section, wherein each of the sub-columns is formed by connecting extension portions extending upward from respective membrane water-cooled walls in the membrane water-cooled walls, which are connected to form the lower section, and the plurality of sub-columns are separated from each other, wherein additional inner secondary air ports are provided on opposite side walls of at least a pair of adjacent sub-columns.

2. The water-cooled column according to claim 1, wherein the upper section comprises two sub-columns.

3. The water-cooled column according to claim 1, wherein the upper section comprises three sub-columns arranged in a line and equidistantly spaced apart from each other.

4. The water-cooled column according to claim 1, wherein the upper section comprises four sub-columns, among which a cross-shaped gap is defined.

5. The water-cooled column according to claim 1, wherein each of the sub-columns has an identical cross-section with any other sub-columns.

6. The water-cooled column according to claim 5, wherein each of the sub-columns has an identical cross-section area with any other sub-columns.

7. The water-cooled column according to claim 1, wherein each of the sub-columns has a cross-section shape chosen from a rectangle, a circle, a regular hexagon and a regular octagon.

8. A circulating fluidized bed boiler furnace, comprising furnace side walls, a ceiling, an air distribution plate and a water-cooled column provided between the air distribution plate and the ceiling, wherein the water-cooled column is formed by connecting side walls which are formed by membrane water-cooled walls, a furnace combustion space is enclosed by the water-cooled column side walls, the furnace side walls, the air distribution plate and the ceiling, inner secondary air ports for injecting secondary air into the furnace combustion space are provided at a lower portion of the water-cooled column side walls, and outer secondary air ports for injecting secondary air into the furnace combustion space are provided at a lower portion of the furnace side walls, wherein the water-cooled column is the water-cooled column according to claim 1.

9. The circulating fluidized bed boiler furnace according to claim 8, wherein an extended heating surface is arranged outside at least one of the sub-columns.

10. A circulating fluidized bed boiler, comprising the circulating fluidized bed boiler furnace according to claim 8.

11. The water-cooled column according to claim 2, wherein each of the sub-columns has an identical cross-section with any other sub-columns.

12. The water-cooled column according to claim 3, wherein each of the sub-columns has an identical cross-section with any other sub-columns.

13. The water-cooled column according to claim 4, wherein each of the sub-columns has an identical cross-section with any other sub-columns.

14. The water-cooled column according to claim 2, wherein each of the sub-columns has a cross-section shape chosen from a rectangle, a circle, a regular hexagon and a regular octagon.

15. The water-cooled column according to claim 3, wherein each of the sub-columns has a cross-section shape chosen from a rectangle, a circle, a regular hexagon and a regular octagon.

16. The water-cooled column according to claim 4, wherein each of the sub-columns has a cross-section shape chosen from a rectangle, a circle, a regular hexagon and a regular octagon.

* * * * *